US009226080B2

(12) United States Patent
Lust et al.

(10) Patent No.: US 9,226,080 B2
(45) Date of Patent: Dec. 29, 2015

(54) FREQUENCY DEPENDENT SWITCH

(71) Applicant: Honeywell International Inc., Morristown, NJ (US)

(72) Inventors: Lisa Lust, Minneapolis, MN (US); Daniel Youngner, Maple Grove, MN (US)

(73) Assignee: Honeywell International Inc., Morris Plains, NJ (US)

( * ) Notice: Subject to any disclaimer, the term of this patent is extended or adjusted under 35 U.S.C. 154(b) by 171 days.

(21) Appl. No.: 14/073,638

(22) Filed: Nov. 6, 2013

(65) Prior Publication Data

US 2015/0125008 A1 May 7, 2015

(51) Int. Cl.

| | |
|---|---|
| ***H04R 25/00*** | (2006.01) |
| ***H04R 19/01*** | (2006.01) |
| ***H04R 19/00*** | (2006.01) |
| *H04R 31/00* | (2006.01) |

(52) U.S. Cl.

CPC ..... *H04R 19/016* (2013.01); *H04R 19/005* (2013.01); *H04R 31/00* (2013.01)

(58) Field of Classification Search

CPC ..... H04R 19/00; H04R 19/005; H04R 19/01; H04R 19/013; H04R 19/016; H04R 2201/003; H04R 1/22; B81B 3/0021

See application file for complete search history.

(56) References Cited

U.S. PATENT DOCUMENTS

2011/0033079 A1* 2/2011 Liou et al. ..... 381/431

* cited by examiner

*Primary Examiner* — Matthew Eason

(74) *Attorney, Agent, or Firm* — Schwegman Lundberg & Woessner, P.A.

(57) ABSTRACT

Generally disclosed herein are transducers that can convert sound energy into electrical signals, such as to detect if a pressure wave includes a specific frequency. Methods of using the transducers and systems that include the transducers are disclosed herein as well. A transducer can include a first probe plate, a second probe plate, a ground plate situated between the first and second probe plates, a first electret film adjacent to a first side of the ground plate and situated between the first and second probe plates, and a second electret film adjacent to a second side of the ground plate and situated between the first and second probe plates, the second side opposite the first side.

17 Claims, 4 Drawing Sheets

FREQUENCY DEPENDENT SWITCH

BACKGROUND

Frequency dependent switches (e.g., voice activated switches) can consume relatively large amounts of power and can include relatively complex circuitry. Distinguishing background noise from the frequencies that will close the switch can be challenging, especially in high noise environments.

SUMMARY

A transducer can include a first probe plate, a second probe plate, a ground plate situated between the first and second probe plates, a first electret film adjacent to a first side of the ground plate and situated at least partially between the first and second probe plates, and a second electret film adjacent to a second side of the ground plate and situated at least partially between the first and second probe plates, the second side opposite the first side.

A system can include a plurality of Resonant Acoustic Transducer (RAT) MicroElectroMechanical System (MEMS), each RAT MEMS can include an output, a first probe plate, a second probe plate, a ground plate situated between the first and second probe plates, a first electret film adjacent to a first side of the ground plate and situated between the first and second probe plates, and a second electret film adjacent to a second side of the ground plate and situated between the first and second probe plates, the second side opposite the first side. The system can include a plurality of multiplier circuits, each multiplier circuit electrically coupled to the output of a respective RAT MEMS or the plurality of RAT MEMS A system can include a first Resonant Acoustic Transducer (RAT) MicroElectroMechanical System (MEMS) configured to produce a first voltage when a pressure wave including an in-band frequency contacts the first RAT MEMS and a second RAT MEMS configured to produce a second voltage when a pressure wave including an out-of-band frequency contacts the second RAT MEMS. The first and second RAT MEMS can include an output, a first probe plate, a second probe plate, a ground plate situated between the first and second probe plates, a first electret film adjacent to a first side of the ground plate and situated between the first and second probe plates, and a second electret film adjacent to a second side of the ground plate and situated between the first and second probe plates, the second side opposite the first side. The system can include a comparator electrically coupled to the outputs of the first and second RAT MEMS, the comparator configured to produce an output current in response to determining a ratio of a first voltage on the output of the first RAT MEMS and a second voltage on the output of the second RAT MEMS is greater than a specified threshold.

DETAILED DESCRIPTION

Figure 1:
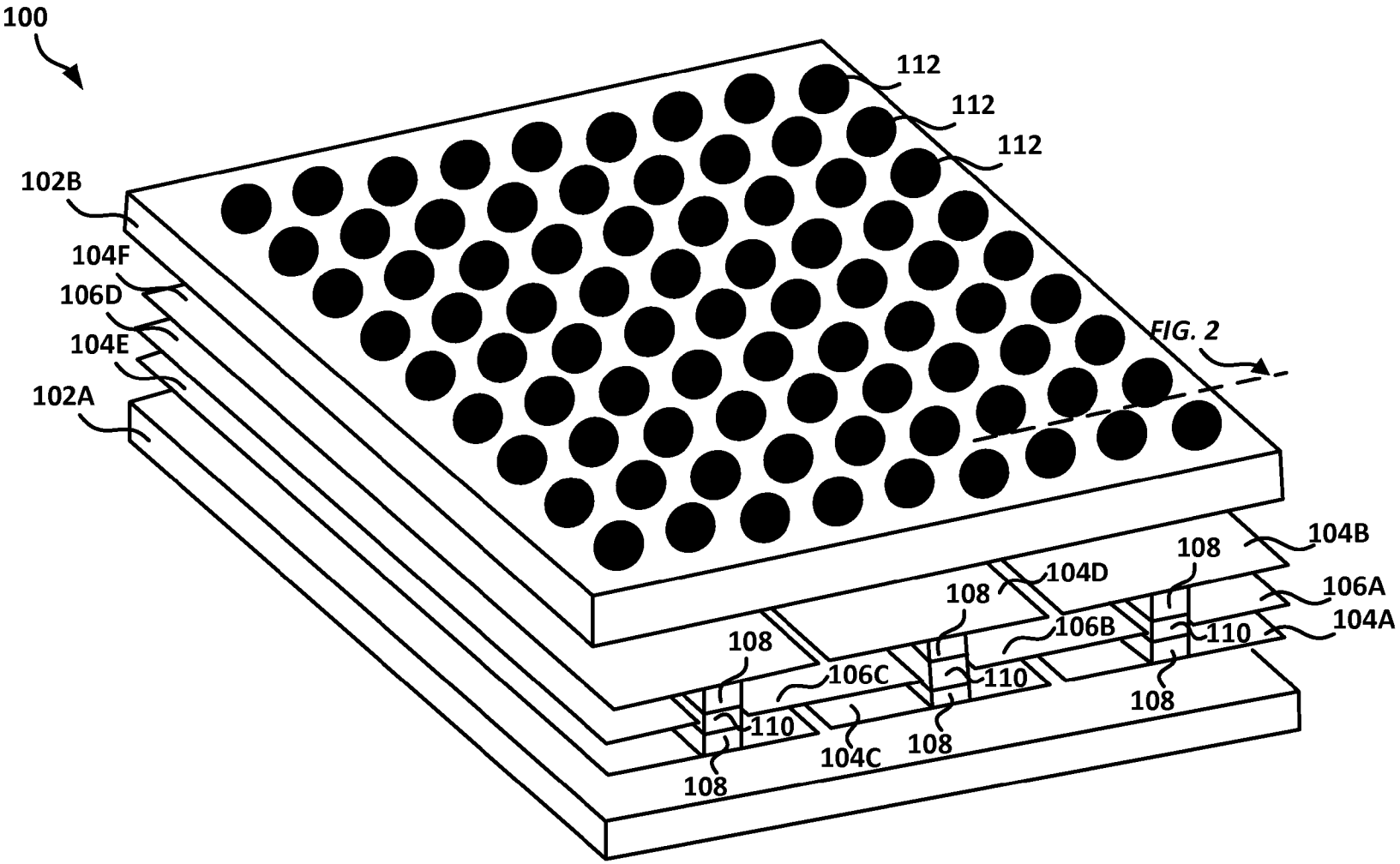
FIG. 1 is a perspective view diagram of an example of a RAT MEMS device.

While embodiments of this invention can take many different forms, specific embodiments thereof are shown in the drawings and will be described herein in detail with the understanding that the present disclosure is to be considered as embodiments of the principles of the disclosure, as well as the best mode of practicing same, and is not intended to limit the disclosure to the specific embodiments illustrated.

An electret film can be a stable dielectric material with a quasi-permanent electric charges embedded therein. Electret films can generate internal and external electric fields. Examples of materials used in electret films include silicon dioxide (e.g., quartz and other forms of silicon dioxide), synthetic polymers (e.g., polypropylene, fluoropolymer, polyethyleneterephthalate, electron or hole infused polytetrafluoroethylene (Teflon®, a registered trademark of DuPont™ Co.), among others. The quasi-permanent electric fields of electrets can be exploited to produce a passive voice, or other frequency-specific, activated switch (VOX).

A Resonant Acoustic Transducer (RAT) array can include an electret film. An array of RATs can form a human voice detector or can detect a specific set of frequencies in a wave that contacts the RATs. By coupling multiple RATs, each of which can resonate at a different frequency, a voiceprint or other set of frequencies (e.g., a specific set of one or more acoustic wave frequencies) can be detected. The magnitude of the voiceprint or other frequencies detected by the RATs can be compared (e.g., using electric or electronic circuitry) to the magnitude of noise detected by RATs. A switch can be configured to close (e.g., a transistor, comparator circuit, or other circuit can be configured to allow current to pass therethrough) in response to determining the voiceprint or other frequencies have a magnitude sufficiently greater than the noise detected. The switch can control current flow to circuitry (e.g., a load) that is configured to operate in response to the switch closing.

Apparatuses, systems, techniques, and software will now be further described with references to figures.

Referring now to FIG. 1, a RAT MicroElectroMechanical System (MEMS) package 100 can include one or more ground plates 102A or 102B, probe plates 104A-F, electret films 106A-D, dielectrics 108, or ground plates 110. The dimensions of the RAT MEMS parts (e.g., ground plates 102A-102B, probe plates 104A-F, electret films 106A-D, dielectrics 108, or ground plates 110) can be compatible with MEMS processing or manufacturing techniques. These dimensions can be adjusted to vary the frequency at which the RAT MEMS resonates, such as to configure the RAT MEMS to resonate at an in-band frequency (e.g., a frequency that is supposed to be detected in order for the switch to close) or an out-of-band frequency (e.g., a frequency that, if detected, should not close the switch).

The ground plate(s) 102A-B can be perforated, such as by including one or more holes 112 therethrough. The hole(s) 112 can allow a pressure wave (e.g., acoustic or sound wave) to pass through the respective ground plate 102A-B to a probe plate 104A, 104B, 104C, 104D, 104E, or 104F. The holes 112 can include any shape, such as a polyhedron or other shape.

The probe plate 104A-F can be made of a substrate, such as a silicon, polysilicon, silicon dioxide, a combination thereof, or other material. A thin conducting film (e.g., a metallic film) can be deposited on the substrate. The probe plate 104A-F can be sized or shaped such that the probe plate resonates at or around the time a pressure wave including a specific frequency or range of frequencies contacts the probe plate 104A-F. By changing the dimensions of the probe plate 104A-F, the frequency at which the probe plate 104A-D resonates can be altered. At or around the time a pressure wave contacts the probe plate 104A-F the probe plate 104A-F can bend, flex, resonate, or otherwise deform from an unstressed or ambient state if the pressure wave includes the specific frequency.

The RAT MEMS package 100 can include one or more electret films 106A, 106B, 106C, or 106D. The electret film (s) can be situated between probe plates 104A-F. FIG. 1 depicts electret film 106A situated between probe plates 104A and 104B, electret film 106B between probe plates 104C and 104D, and 104A and 104B, etc. At or around the time the probe plate 104A-F deforms so that at least a portion of the probe plate 104A-F becomes closer to the electret film(s) 106A-D (as compared to distance from the probe plate 104A-F to the electret film(s) 106A-D in the unstressed or ambient state) the probe plate 104A-F can pick up, at least temporarily, electrons or holes from the electret film and become more negatively or positively charged as a result. The difference in charge (e.g., voltage) on two opposing probe plates 104A-F (e.g., probe plates 104A and 104B, 104C and 104D, and 104E and 104F each respectively oppose each other in FIG. 1) can be monitored. If the difference in charge is sufficiently high, it can be determined that the pressure wave includes the frequency that the probe plate 104A-F was designed to deform to or resonate at (e.g., the frequency that the probe plate 104A-F was configured to deform to in response to a pressure waving including that frequency contacting the probe plate 104A-F).

The RAT MEMS package 100 can include one or more dielectrics 108 (e.g., silicon dioxide, silicon nitride, polysilicon, silicon, a combination thereof, or other insulating materials) coupled to a respective probe plate 104A-F. The dielectric layers can be separated by a ground plate 110. The dielectrics 108 or ground plates 110 can help electrically isolate opposing probe plates 104A-F. The dielectric layers 108 or ground plates 110 can help center the acoustic cantilever into an equilibrium position (e.g., the ground plate can remove excess charges from the probe plates 104A-F, such as through the dielectric layers 108).

Figure 2:
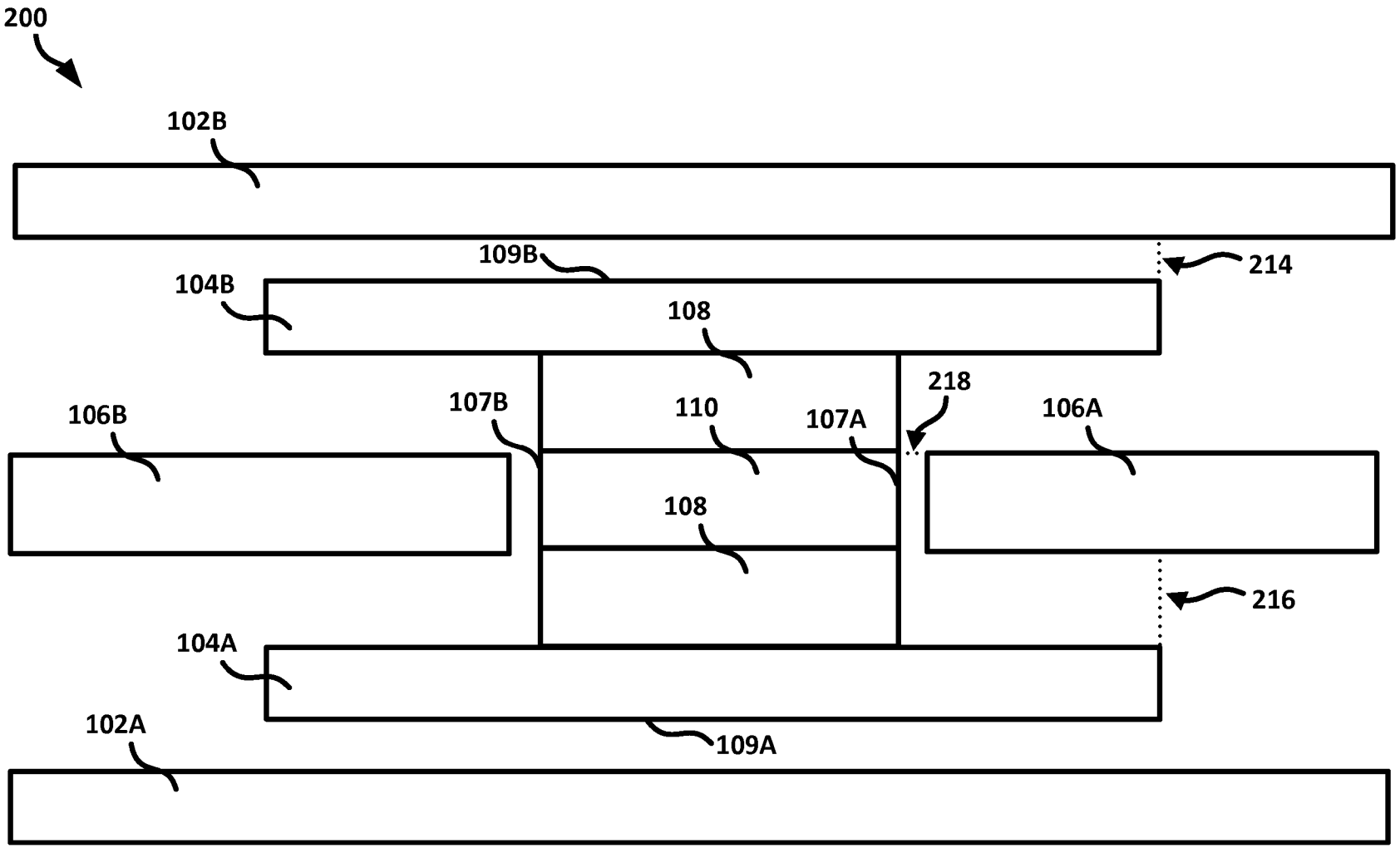
FIG. 2 is a cross-section diagram view of the example of the RAT MEMS shown in FIG. 1.

FIG. 2 is a vertical cross-sectional view diagram of a portion 200 of the example of the RAT MEMS package 100 of FIG. 1. The probe plates 104A-B, dielectrics 108, and ground plate 110 can form an acoustic cantilever that is generally shaped like a capital "I". The ground plate 110 can be "sandwiched" between the two dielectrics 108 and the dielectrics can be sandwiched between the ground plate 110 and opposing probe plates 104A and 104B, such as shown in FIG. 2. The electret films 106A and 106B can be situated adjacent the ground plate 110 or the dielectric 108. The electret films 106A can be situated adjacent to opposing sides 107A and 107B of the ground plate 110.

The acoustic cantilever can be situated between (e.g., sandwiched between) two ground plates 102A and 102B. The probe plate 104A can be situated adjacent to the ground plate 102A. The ground plate 102A can below the bottom surface 109A of the probe plate 104A. The probe plate 104B can be situated adjacent to the ground plate 102B. The ground plate 102B can be situated above a top surface 109B of the probe plate 104B.

The acoustic cantilevers can be clamped (e.g., singly or doubly clamped) on either end to a rigid wall (e.g., a side of a container). The electret films 106A-D can likewise be clamped on one or both ends. The ground plates 102A-B can form the top and bottom of a container of the RAT MEMS. The electret films 106A-D and the ground plates 102A-102B can be rigid, such as to have little or no flex. The acoustic cantilever can be sufficiently flexible to resonate, flex, or otherwise deform from an unstressed position in response to a pressure wave with a specific frequency contacting the acoustic cantilever.

A plurality of acoustic cantilevers can be coupled (e.g., electrically) so as to form an array of two or more acoustic cantilevers. FIG. 1 depicts an array of three acoustic cantilevers arranged in an array (e.g., a first acoustic cantilever can include probe plates 104A and 104B with two dielectrics 108 and a ground plate 110 situated therebetween; a second acoustic cantilever includes probe plates 104C and 104D with two dielectrics 108 and a ground plate 110 situated therebetween; and a third acoustic cantilever includes probe plates 104E and 104F with two dielectrics 108 and a ground plate 110 situated therebetween). While FIG. 1 depicts an array of three acoustic cantilevers or RAT devices, the array can include two or more such structures or devices.

The array of RAT devices or acoustic cantilevers can be configured such that one or more RAT devices is configured to resonate or deform at a frequency considered to be noise (e.g., a frequency that is not supposed to trigger the switch to close or an out-of-band signal) and one or more RAT devices is configured to resonate at a frequency that is considered to be the signal (e.g., a frequency that is supposed to trigger the switch to close, current to otherwise flow, or an in-band signal). The signals provided by the in-band signal and out-of-band signal RAT devices can be compared to determine if the signal has a sufficient magnitude or is sufficiently greater than the noise. If the condition for magnitude or sufficiently greater than is met than the switch can close, such as to connect a battery to a circuit and power the circuit with the battery.

One or more electret films 106A-D can be situated between the probe plates 104A-F of the acoustic cantilever. The electret film 106A-D can be situated so as to provide a gap 216 between a probe plate 104A-F and the electret film 106A-D. The gap 216 can be configured so as to allow the probe plate 104A-F to deform, such as without contacting the electret film 106A-D. The probe plates 104A-F can be situated between ground plates 102A-B so as to provide a gap 214 between the probe plate 104A-F and the proximate ground plate 102A-B. The gap 214 can be configured so as to allow the probe plate 104A-F to deform, such as without contacting the proximate ground plate 102A-B. The electret films 106A-D can be situated adjacent to the ground plate 110 with a gap 218 therebetween. The gap 218 can help ensure that the charges on the electret film 106A-D remain on the electret film 106A-D and are not discharged through the ground plate 110.

Figure 3:
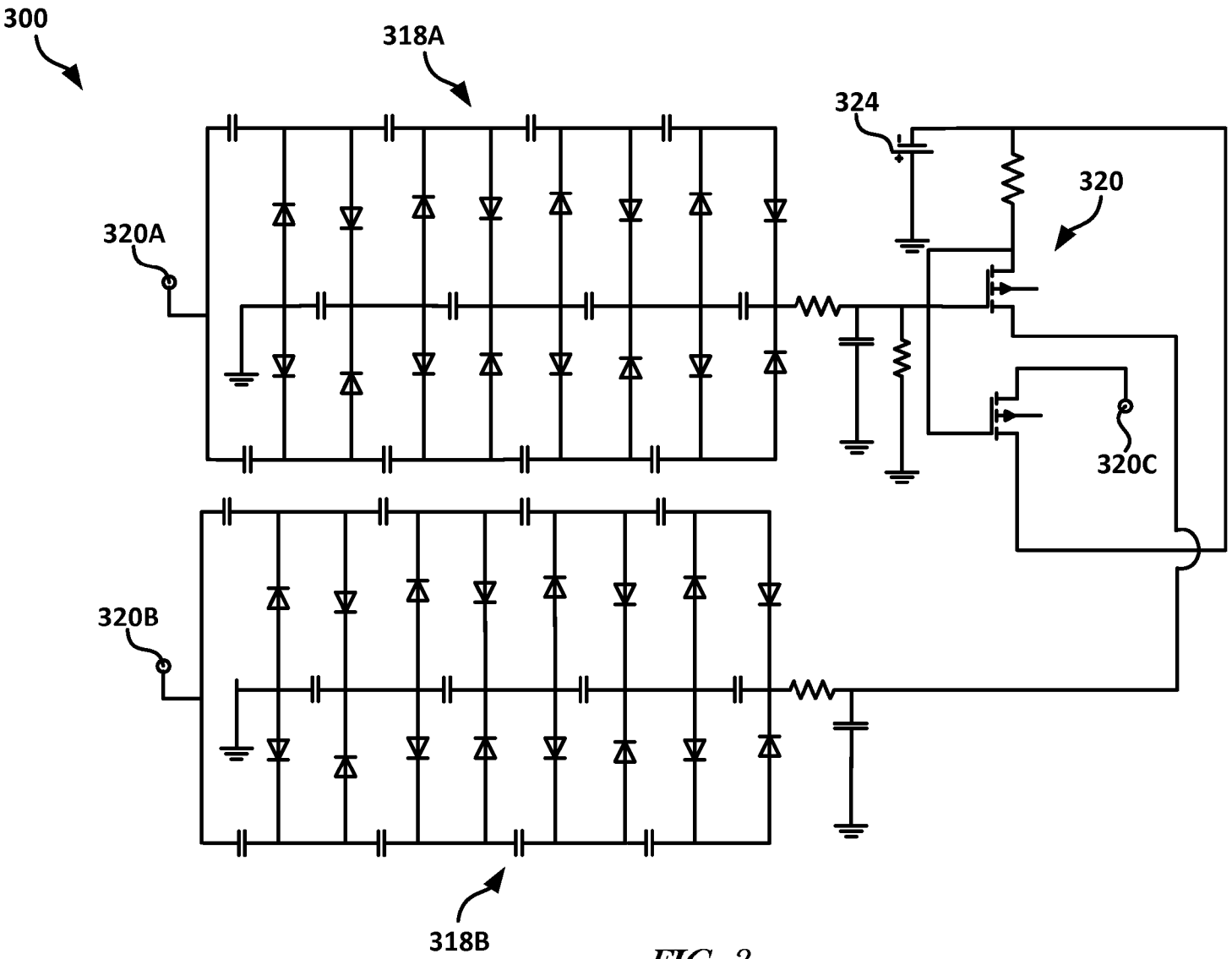
FIG. 3 is a circuit diagram of an example of a Crockoft-Walton multiplier.

FIG. 3 shows an example of a switch circuit 300. The switch circuit 300 can be configured to implement a spectral subtractive discrimination technique implemented in hardware. The switch circuit 300 can include one or more multiplier circuits 318A and 318B. The multiplier circuits 318A-B can be Crockoft-Walton multiplier circuits, such as shown in FIG. 3. The Crockoft-Walton multiplier type of architecture can be well suited for voltage multiplication in low or ultra-low current applications.

An in-band signal can be received from a RAT device that is configured to resonate or deform at a frequency that is supposed to be detected, such as at 320A. An out-of-band signal can be received from another RAT device, such as at 320B. The relative magnitudes can be compared, such as by using comparator 322 (e.g., the two Field Effect Transistors (FETs) shown in FIG. 3). The comparator 322 can switch closed and allow current to flow therethrough, such from battery 324, to the load on signal line 320C when the magnitude of the in-band signal received on the signal line 320A is sufficiently large, such as in comparison to the out-of-band signal received on the noise line 320B.

The multiplier circuits 318A and 318B can be configured to multiply the signals received on their respective inputs lines 320A and 320B by about the same multiplicand or different multiplicands. In the example shown in FIG. 3, the multiplicand is about four (4); however any multiplicands can be used. By adjusting the multiplicand value, the relative magnitude difference between the signal received on the in-band signal received on line 320A and the out-of-band signal received on the signal line 320B can be required to be greater or lesser. For example, by increasing the multiplicand of the multiplier 318A, the in-band signal received on the signal line 320A can trigger the switch to close (e.g., the comparator can allow current to flow therethrough) when the signal received on the signal line 320A has a smaller magnitude as compared to when the multiplier 318A is configured for a smaller multiplicand.

The various ratios of Signal to Noise Ratios (SNR) which can be the magnitude of the in-band signal received on signal line 320A divided by the magnitude of the out-of-band signal received on signal line 320B can be explored via the passive Crockcroft-Walton passive multiplier and FETs. These circuit elements can be powered strictly from the signals received on the signal lines 320A and 320B.

The Crockcoft-Walton multiplication factor can be frequency dependent. A threshold of SNR can be adjusted according to the ratio of frequency bands being examined in order to attain a desired SNR to trigger the switch to close. The SNR required to close the switch in FIG. 3 is any SNR greater than one (1). Thus, only if the signal on the signal line 320A exceeds the noise on the signal line 320B will the switch circuit 300 close the switch.

Several switch circuits, such as the switch circuit of FIG. 3, in parallel can determine SNR ratios over different frequency bands. In this way, broadband spectral characteristics of the SNR can be collectively evaluated to assist in guarding against false detection.

A RAT device configured to close a switch can be passive with a low current draw in the open switch state. Current draw with the switch in the open state (e.g., a comparator not allowing current to pass therethrough) can be limited to the leakage current of components in the switch circuit or other components on the signal side of the switch (as opposed to the load side of the circuit, see FIG. 3). The only power consumption drawn from the battery 324 of FIG. 3 can be that of the FET leakage current (e.g., about 10 nA), such as up until about the time the switch closes and powers the load on signal line 320C.

An "I" shaped acoustic cantilever configuration can generate a generally symmetrical electric field. The electrical field can be symmetrical about a line approximately down the vertical stem of the "I", such as to make the beam resonate vertically, such as to move the acoustic cantilever closer or further from the ground plates 102A and 102B or increase or decrease the size of the gap 214, and not left and right, such as to reduce or increase the size of the gap 218. The entire "I" shaped acoustic cantilever can resonate, move, vibrate, or deform in response to a pressure wave of a specified frequency or range of frequencies contacting the acoustic cantilever.

An acoustic cantilever can include two probe plates 104A-F (e.g., floating probe plates) insulated from a well-grounded middle plate (e.g., ground plate 110), such as by dielectric 108. Such a configuration can be used to center the cantilever into an equilibrium position between the two electret films 106A-D. Also, such a configuration can reduce or eliminate stress gradients that can cause MEMs beams to curl. The electric force produced by the electric fields can self-adjust the RAT device into a controlled configuration for unperturbed (e.g., unstressed or ambient) conditions. Such a, "I" shaped configuration can provide the ability to design the spring force constant of the cantilever, such as to adjust the cantilever's resonant frequency. Such adjustments can allow an array of cantilevers to be configured to detect a plurality of different frequencies. The switch (e.g., comparator) can be configured to close or allow current to flow only when all of the plurality of different frequencies are detected, such as with a magnitude that is sufficiently greater than detected noise. For example, a RAT VOX can detect if frequencies of about 225 Hz and 500 Hz are present and of sufficient magnitude in a pressure wave that is contacting the RAT VOX, and if the conditions are met, the switch can be closed and current can be supplied to a load.

Figure 4:
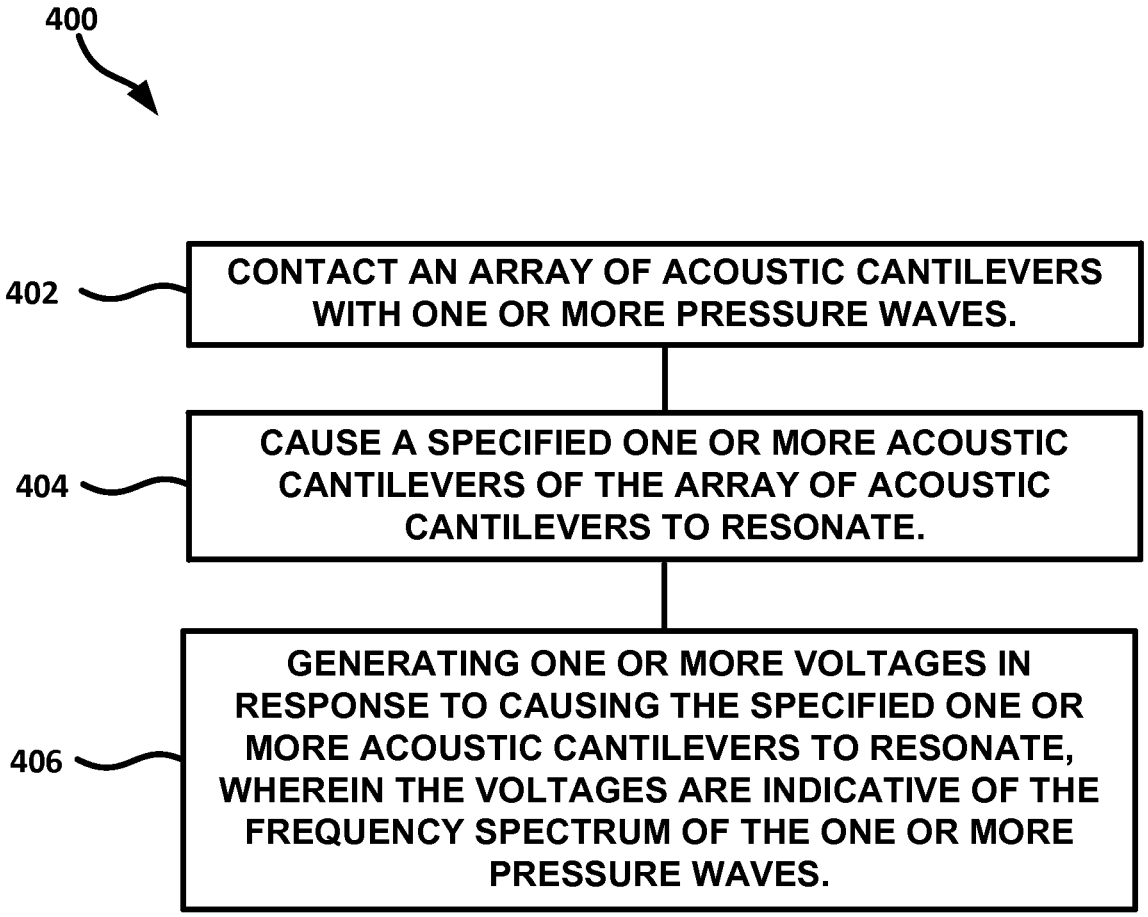
FIG. 4 shows an example of a technique for determining a frequency spectrum of a pressure wave.

FIG. 4 shows a technique 400 for determining a frequency spectrum of a pressure wave. At 402, an array of acoustic cantilevers can be contacted with one or more pressure waves. The array of acoustic cantilevers can include a plurality of acoustic cantilevers, each of which is configured to resonate at a different frequency. The acoustic cantilever can be any acoustic cantilever discussed herein. At 404, a specified one or more acoustic cantilevers of the array of acoustic cantilevers can be caused to resonate, such as in response to being contacted by the one or more pressure waves.

At 406, one or more voltages can be generated in response to causing the specified one or more acoustic cantilevers to resonate. The voltages can indicate what frequencies are included in the frequency spectrum of the one or more pressure waves. The voltages can be produced by reducing the size of the gap 216 as described above. A switch can be configured to close in response to the voltages being consistent with the pressure wave including a specified frequency spectrum (e.g., including specific frequencies or including specific frequencies that have a magnitude sufficiently larger than other frequencies in the frequency spectrum of the pressure wave).

While one or more embodiments described herein are described with reference to detecting voice frequencies, a wide variety of pressure wave frequencies can be detected using RAT MEMS described herein. For example, a RAT MEMS can be configured to close a switch in response to detecting frequencies indicative of a gunshot or fireworks. Or a RAT MEMS can be configured to consider the fireworks noise and only close when a pressure wave with a frequency spectrum consistent with a gunshot contacts the RAT MEMS. It should be appreciated that many other applications of the RAT MEMS are possible.

NOTES AND EXAMPLES

Example 1 can include or use subject matter (such as an apparatus, a method, a means for performing acts, or a device readable memory including instructions that, when performed by the device, can cause the device to perform acts), such as can include or use a transducer that can include a first probe plate, a second probe plate, a ground plate situated between the first and second probe plates, a first electret film adjacent to a first side of the ground plate and situated at least partially between the first and second probe plates, and a second electret film adjacent to a second side of the ground plate and situated at least partially between the first and second probe plates, the second side opposite the first side.

Example 2 can include or use, or can optionally be combined with the subject matter of Example 1, to optionally include or use a second ground plate adjacent a top surface of the first probe plate, or a third ground plate adjacent a bottom surface of the second probe plate.

Example 3 can include or use, or can optionally be combined with the subject matter of at least one of Examples 1 and 2, to optionally include or use a first dielectric situated between the first probe plate and the first ground plate, and a second dielectric situated between the second probe plate and the first ground plate.

Example 4 can include or use, or can optionally be combined with the subject matter of at least one of Examples 1-3, to optionally include or use wherein the first and second probe plates, first ground plate, and first and second dielectrics form an acoustic cantilever that is generally "I" shaped in a vertical cross-section.

Example 5 can include or use, or can optionally be combined with the subject matter of at least one of Examples 1-4, to optionally include or use wherein the second and third ground plates are perforated.

Example 6 can include or use, or can optionally be combined with the subject matter of at least one of Examples 1-5, to optionally include or use wherein the first and second dielectrics are made of silicon dioxide.

Example 7 can include or use, or can optionally be combined with the subject matter of at least one of Examples 1-6 to optionally include or use wherein the first probe plate is configured to flex in response to a pressure wave including a specific frequency contacting the first probe plate so as to reduce a distance between the first probe plate and the first electret film and induce a voltage difference between the first probe plate and the first electret film.

Example 8 can include or use, or can be optionally be combined with the subject matter of at least one of Examples 1-7, to include subject matter (such as an apparatus, a method, a means for performing acts, or a device readable memory including instructions that, when performed by the device, can cause the device to perform acts), such as can include or use a plurality of Resonant Acoustic Transducer (RAT) MicroElectroMechanical System (MEMS), wherein each RAT MEMS can include an output, a first probe plate, a second probe plate, a ground plate situated between the first and second probe plates, a first electret film adjacent to a first side of the ground plate and situated between the first and second probe plates, and a second electret film adjacent to a second side of the ground plate and situated between the first and second probe plates, the second side opposite the first side. Example 8 can include a plurality of multiplier circuits, each multiplier circuit electrically coupled to the output of a respective RAT MEMS or the plurality of RAT MEMS.

Example 9 can include or use, or can optionally be combined with the subject matter of at least one of Examples 1-8 to optionally include or use wherein each RAT MEMS can include a second ground plate adjacent a top surface of the first probe plate, and a third ground plate adjacent a bottom surface of the second probe plate.

Example 10 can include or use, or can optionally be combined with the subject matter of at least one of Examples 1-9 to optionally include or use wherein each RAT MEMS can include a first dielectric situated between the first probe plate and the first ground plate, and a second dielectric situated between the second probe plate and the first ground plate.

Example 11 can include or use, or can optionally be combined with the subject matter of at least one of Examples 1-10 to optionally include or use wherein the first and second probe plates, the first ground plate, and the first and second dielectrics of each RAT MEMS form an acoustic cantilever that is generally "I" shaped in a vertical cross-section.

Example 12 can include or use, or can optionally be combined with the subject matter of at least one of Examples 1-11 to optionally include or use wherein the second and third ground plates of each RAT MEMS are perforated.

Example 13 can include or use, or can optionally be combined with the subject matter of at least one of Examples 1-12 to optionally include or use wherein the first and second dielectrics of each RAT MEMS are made of silicon dioxide.

Example 14 can include or use, or can optionally be combined with the subject matter of at least one of Examples 1-13 to optionally include or use wherein each multiplier circuit is a Crockoft Walton multiplier circuit.

Example 15 can include or use, or can be optionally be combined with the subject matter of at least one of Examples 1-14, to include subject matter (such as an apparatus, a method, a means for performing acts, or a device readable memory including instructions that, when performed by the device, can cause the device to perform acts), such as can include or use a first Resonant Acoustic Transducer (RAT) MicroElectroMechanical System (MEMS) configured to produce a first voltage when a pressure wave including an in-band frequency contacts the first RAT MEMS, a second RAT MEMS configured to produce a second voltage when a pressure wave including an out-of-band frequency contacts the second RAT MEMS, the first and second RAT MEMS each can each include an output, a first probe plate, a second probe plate, a ground plate situated between the first and second probe plates, a first electret film adjacent to a first side of the ground plate and situated between the first and second probe plates, and a second electret film adjacent to a second side of the ground plate and situated between the first and second probe plates, the second side opposite the first side. Example 15 can include a comparator electrically coupled to the outputs of the first and second RAT MEMS, the comparator configured to produce an output current in response to determining a ratio of a first voltage on the output of the first RAT MEMS and a second voltage on the output of the second RAT MEMS is greater than a specified threshold.

Example 16 can include or use, or can optionally be combined with the subject matter of at least one of Examples 1-15 to optionally include or use a first multiplier circuit coupled between the output of the first RAT MEMS and the comparator, and a second multiplier circuit coupled between the output of the second RAT MEMS and the comparator.

Example 17 can include or use, or can optionally be combined with the subject matter of at least one of Examples 1-16 to optionally include or use wherein the first and second multiplier circuits are Crockoft Walton multiplier circuits.

Example 18 can include or use, or can optionally be combined with the subject matter of at least one of Examples 1-17 to optionally include or use wherein the ground plate of each of the first and second RAT MEMS is a first ground plate and each of the first and second RAT MEMS can include a second ground plate adjacent a top surface of the first probe plate, a third ground plate adjacent a bottom surface of the second probe plate, a first insulator situated between the first probe plate and the first ground plate, and a second insulator situated between the second probe plate and the first ground plate.

Example 19 can include or use, or can optionally be combined with the subject matter of at least one of Examples 1-18 to optionally include or use wherein the first and second probe plates, first ground plate, and first and second insulators of each of the first and second RAT MEMS forms a respective acoustic cantilever that is generally "I" shaped in a vertical cross-section.

Example 20 can include or use, or can optionally be combined with the subject matter of at least one of Examples 1-19 to optionally include or use wherein the second and third ground plates of each of the first and second RAT MEMS are perforated and the first and second insulators of each of the first and second RAT MEMS are made of silicon dioxide.

Example 21 can include or use, or can be optionally be combined with the subject matter of at least one of Examples 1-20, to include subject matter (such as an apparatus, a method, a means for performing acts, or a device readable memory including instructions that, when performed by the device, can cause the device to perform acts), such as can include or use contacting an array of acoustic cantilevers with one or more pressure waves. Example 21 can optionally include or use wherein the array of acoustic cantilevers can include a plurality of acoustic cantilevers, each respective acoustic cantilever configured to resonate at a different frequency.

Example 22 can include or use, or can optionally be combined with the subject matter of at least one of Examples 1-21 to optionally include or use resonating one or more acoustic cantilevers of the array of acoustic cantilevers in response to the respective acoustic cantilevers being contacted by the one or more pressure waves.

Example 23 can include or use, or can optionally be combined with the subject matter of at least one of Examples 1-22 to include or use generating one or more voltages in response to causing the specified one or more acoustic cantilevers to resonate. Example 23 can optionally include or use wherein the voltages can indicate what frequencies are included in the frequency spectrum of the one or more pressure waves. Example 23 can optionally include or use wherein the voltages can be produced by reducing the size of the gap 216.

Example 24 can include or use, or can optionally be combined with the subject matter of at least one of Examples 1-23 to include or use closing a switch in response to the voltages being consistent with the pressure wave including a specified frequency spectrum.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in this document, the terms "first," "second," and "third," etc. are used merely as labels, and are not intended to impose numerical requirements on their objects.

As used herein, a "-" (dash) used when referring to a reference number means or, in the non-exclusive sense discussed in the previous paragraph, of all elements within the range indicated by the dash. For example, 103A-B means a nonexclusive or of the elements in the range {103A, 103B}, such that 103A-103B includes "103A but not 103B", "103B but not 103A", and "103A and 103B".

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A transducer comprising:

a first probe plate;

a second probe plate;

a first ground plate situated between the first and second probe plates;

a first electret film adjacent to a first side of the ground plate and situated at least partially between the first and second probe plates;

a second electret film adjacent to a second side of the ground plate and situated at least partially between the first and second probe plates, the second side opposite the first side;

a second ground plate adjacent a top surface of the first probe plate;

a third ground plate adjacent a bottom surface of the second probe plate;

a first dielectric situated between the first probe plate and the first ground plate; and a second dielectric situated between the second probe plate and the first ground plate, wherein the first and second probe plates, first ground plate, and first and second dielectrics form an acoustic cantilever that is generally "I" shaped in a vertical cross-section.

2. The transducer of claim 1, wherein the second and third ground plates are perforated.

3. The transducer of claim 2, wherein the first and second dielectrics are made of silicon dioxide.

4. The transducer of claim 3, wherein the first probe plate is configured to flex in response to a pressure wave including a specific frequency contacting the first probe plate so as to reduce a distance between the first probe plate and the first electret film and induce a voltage difference between the first probe plate and the first electret film.

5. A system comprising:

a plurality of Resonant Acoustic Transducer (RAT) Micro-ElectroMechanical System (MEMS), each RAT MEMS comprising:

an output;

a first probe plate;

a second probe plate;

a ground plate situated between the first and second probe plates;

a first electret film adjacent to a first side of the ground plate and situated between the first and second probe plates; and a second electret film adjacent to a second side of the ground plate and situated between the first and second probe plates, the second side opposite the first side; and a plurality of multiplier circuits, each multiplier circuit electrically coupled to the output of a respective RAT MEMS of the plurality of RAT MEMS.

6. The system of claim 5, wherein the ground plate of each of the plurality of RAT MEMS is a first ground plate and each of the RAT MEMS further comprises:

a second ground plate adjacent a top surface of the first probe plate; and a third ground plate adjacent a bottom surface of the second probe plate.

7. The system of claim 6, wherein each RAT MEMS further comprises:

a first dielectric situated between the first probe plate and the first ground plate; and a second dielectric situated between the second probe plate and the first ground plate.

8. The system of claim 7, wherein the first and second probe plates, the first ground plate, and the first and second dielectrics of each RAT MEMS form an acoustic cantilever that is generally "I" shaped in a vertical cross-section.

9. The system of claim 8, wherein the second and third ground plates of each RAT MEMS are perforated.

10. The system of claim 9, wherein the first and second dielectrics of each RAT MEMS are made of silicon dioxide.

11. The system of claim 10, wherein each multiplier circuit is a Crockoft Walton multiplier circuit.

12. A system comprising:

a first Resonant Acoustic Transducer (RAT) MicroElectro-Mechanical System (MEMS) configured to produce a first voltage when a pressure wave including an in-band frequency contacts the first RAT MEMS;

a second RAT MEMS configured to produce a second voltage when a pressure wave including an out-of-band frequency contacts the second RAT MEMS, the first and second RAT MEMS each comprising:

an output;

a first probe plate;

a second probe plate;

a ground plate situated between the first and second probe plates;

a first electret film adjacent to a first side of the ground plate and situated between the first and second probe plates; and a second electret film adjacent to a second side of the ground plate and situated between the first and second probe plates, the second side opposite the first side; and a comparator electrically coupled to the outputs of the first and second RAT MEMS, the comparator configured to produce an output current in response to determining a ratio of a first voltage on the output of the first RAT MEMS and a second voltage on the output of the second RAT MEMS is greater than a specified threshold.

13. The system of claim 12, further comprising:

a first multiplier circuit coupled between the output of the first RAT MEMS and the comparator; and a second multiplier circuit coupled between the output of the second RAT MEMS and the comparator.

14. The system of claim 13, wherein the first and second multiplier circuits are Crockoft Walton multiplier circuits.

15. The system of claim 14, wherein the ground plate of each of the first and second RAT MEMS is a first ground plate and each of the first and second RAT MEMS further comprises:

a second ground plate adjacent a top surface of the first probe plate;

a third ground plate adjacent a bottom surface of the second probe plate;

a first insulator situated between the first probe plate and the first ground plate; and a second insulator situated between the second probe plate and the first ground plate.

16. The system of claim 15, wherein the first and second probe plates, first ground plate, and first and second insulators of each of the first and second RAT MEMS forms a respective acoustic cantilever that is generally "I" shaped in a vertical cross-section.

17. The system of claim 16, wherein the second and third ground plates of each of the first and second RAT MEMS are perforated and the first and second insulators of each of the first and second RAT MEMS are made of silicon dioxide.

* * * * *